US007773463B2

(12) United States Patent
Corthesy et al.

(10) Patent No.: US 7,773,463 B2
(45) Date of Patent: Aug. 10, 2010

(54) TIMEPIECE COMPRISING A MINUTE REPEATER MECHANISM

(75) Inventors: Yves Corthesy, La Chaux-de-Fonds (CH); Jean-Pierre Charpier, Morteau (FR)

(73) Assignee: LVMH Swiss Manufactures SA, La Chaux-De-Fonds (CH)

( * ) Notice: Subject to any disclaimer, the term of this patent is extended or adjusted under 35 U.S.C. 154(b) by 23 days.

(21) Appl. No.: 11/910,074

(22) PCT Filed: Mar. 30, 2006

(86) PCT No.: PCT/EP2006/061171

§ 371 (c)(1),
(2), (4) Date: Sep. 28, 2007

(87) PCT Pub. No.: WO2006/103267

PCT Pub. Date: Oct. 5, 2006

(65) Prior Publication Data

US 2008/0192585 A1 Aug. 14, 2008

(30) Foreign Application Priority Data

Mar. 31, 2005 (EP) ..... 05102567

(51) Int. Cl.
*G04C 23/00* (2006.01)

(52) U.S. Cl. ..... 368/75

(58) Field of Classification Search ..... 368/72–75, 368/243, 244, 259, 260, 267–271
See application file for complete search history.

(56) References Cited

U.S. PATENT DOCUMENTS 447,973 A * 3/1891 Reber ..... 368/268
3,520,126 A * 7/1970 Kolodziej ..... 368/75
3,778,997 A * 12/1973 Jauch ..... 368/75
4,036,005 A * 7/1977 Jauch ..... 368/269
4,358,838 A * 11/1982 Nakamura ..... 368/75
7,330,403 B2 * 2/2008 Goeller ..... 368/75

FOREIGN PATENT DOCUMENTS

| | | |
|---|---|---|
| CH | 13805 | 8/1897 |
| CH | 25779 | 6/1903 |
| CH | 28285 | 4/1904 |
| EP | 1429214 | 6/2004 |

OTHER PUBLICATIONS

International Search Report PCT/EP2006/061171 related to subject application.
European Search Report EP054102567 related to subject application.
"Théorie de l'horlogerie" by Reymondin et al, Fédération des Ecoles Techniques, 1998, ISBN 2-940025-10-x, pp. 219 to 224. (No English Translation available. Relevance explained in English translation of subject application on p. 2, paragraph [004]).
Automated English Translation (Abstract) of above Foreign Patent (D) No. EP14929214 as obtained from website http://www.espacenet.com.
English translation of the Written Opinion of the International Searching Authority of PCT/EP2006/061171 which is related to subject application.

* cited by examiner

*Primary Examiner*—Edwin A. Leon
(74) *Attorney, Agent, or Firm*—Townsend M. Belser, Jr.; Nexsen Pruet, LLC

(57) ABSTRACT

For a timepiece movement, a striking train mechanism having: at least one resonant element (32) which can emit at least two sounds of different frequencies, at least two pallets (36), and at least two hammers (34) which are designed to be driven by the pallets (36) in order to strike the resonant element (32).

20 Claims, 8 Drawing Sheets

TIMEPIECE COMPRISING A MINUTE REPEATER MECHANISM

BACKGROUND OF THE INVENTION

1) Field of the Invention

The present invention relates to the field of mechanical horology. It concerns, more particular, a mechanism known by one skilled in the art under the name of minute repeater.

2) Description of Related Art

A device of this type makes it possible to indicate, upon request, the time to the closest minute, using blows struck by two hammers on two different gongs. The hammers are actuated by pallets which are lifted by a striking mechanism. This mechanism comprises an hour part, quarter part and minute part, equipped with twelve, three and fourteen teeth respectively to strike the hours, quarters and minutes.

In order to control the movement of these pieces, an hour snail is disposed on a star having twelve teeth, advancing by one step each hour, while a quarter snail and minute snail are adjusted on the rod of the cannon-pinion. Three levers, each provided with a sensing arm cooperating with these snails, make it possible to determine the travel of the hour, quarter and minute parts and to adjust the number of blows struck.

One will find other details on this type of complication, in particular on the driving force of the repeater or on the trigger step, meaning on triggering of the striking mechanism, in the book "Théorie de l'horlogerie" by Reymondin et al, Fédération des Ecoles Techniques, 1998, ISBN 2-940025-10-X, pages 219 to 224.

One of the many complexities of this mechanism comes from the large number of parts which must be coordinated and adjusted so as to achieve proper operation.

SUMMARY OF THE INVENTION

The present invention aims to propose a new minute repeater mechanism, implementing a relatively small number of parts, which makes it simpler to develop.

More precisely, the invention relates to a striking part intended to be integrated into a minute repeater mechanism, comprising a rack which has, successively, along one of its edges, a toothed hour section, a tooth-free space and a toothed minute section.

Advantageously, the toothed minute and hour sections of this striking part are located in different planes.

Moreover, the invention relates to a timepiece comprising a minute repeater mechanism which is equipped with:

- a power source powering said mechanism,
- a control member to actuate said mechanism,
- a counting member to take information on the current time, including:
  - an hour snail, an hour sensing arm,
  - a quarter snail, a quarter sensing arm,
  - a minute snail, a minute sensing arm,
- a toothed hour section, one for quarters and one for minutes mounted rotatably and whereof the movement is determined by the counting member, and
- means for emitting a sound comprising:
  - two pallets which can be actuated by one and/or the other of the toothed sections,
  - two hammers moved by the pallets, and
  - two gongs whereon the hammers strike to emit a sound.

Advantageously, the toothed hour and minute sections are located on a striking part as defined above.

Another aspect of the invention relates to a striking mechanism comprising at least one resonant element which can emit at least two sounds of different frequencies, at least two pallets disposed coaxially and each comprising:

- a beak which cooperates with the toothed sections mounted mobile in said movement in order to cause said pallets to rotate,
- a positioning surface whereon an elastic member bears to keep the pallets in their resting position, and
- a pallet-stone which acts directly on the pin comprised by the hammers.

The striking mechanism also comprises at least two hammers each comprising a pin whereon the pallet acts directly to cause them to strike said resonant element.

Advantageously, the pallet-stone of a first pallet is positioned so as to act on the pin of a first hammer during a winding phase of its rotational movement in a first direction, and the pallet stone of a second pallet is positioned so as to act on the pin of a second hammer during a descending phase of its rotational movement in said first direction.

BRIEF DESCRIPTION OF THE DRAWINGS

Other details will appear more clearly upon reading the following description, done with regard to the appended drawing in which.

DETAILED DESCRIPTION OF THE INVENTION

Figure 1A:
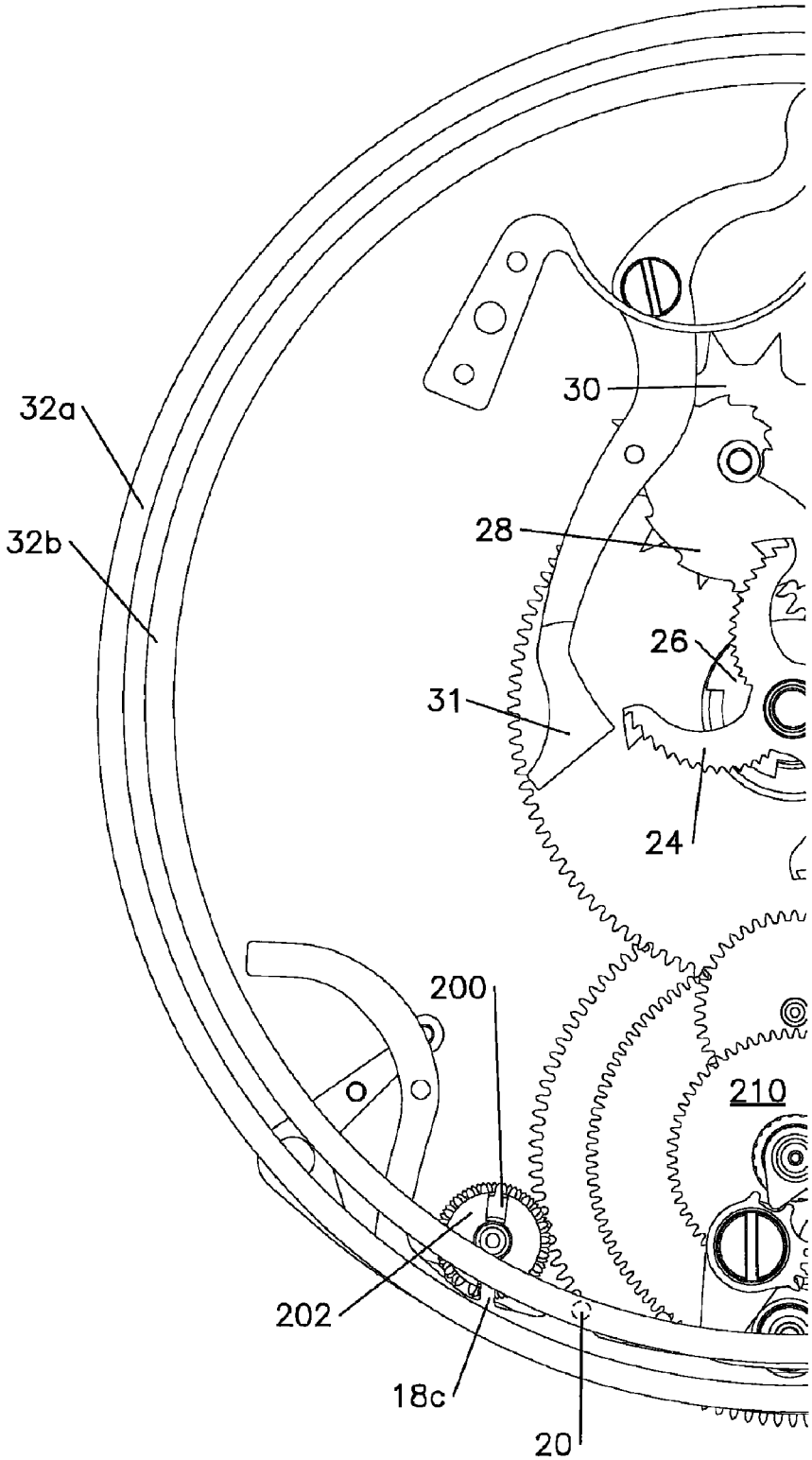
FIGS. 1*a* and 1*b* are top views of the mechanism at rest, the complete view being divided between the two figures.

The minute repeater mechanism according to the invention is described below in reference to FIG. 1. It is placed in a traditional timepiece movement whereof the common elements, for purposes of clarity, are not illustrated. Likewise, the plate, whereon the parts of the repeater are assembled, does not appear in the drawing.

Winding and Actuation

The power needed to operating the repeater is supplied by a striking barrel 10 which is wound, either by a rack which the wearer actuates, or by an oscillating weight automatic winding system, or by manual winding.

Figure 2:
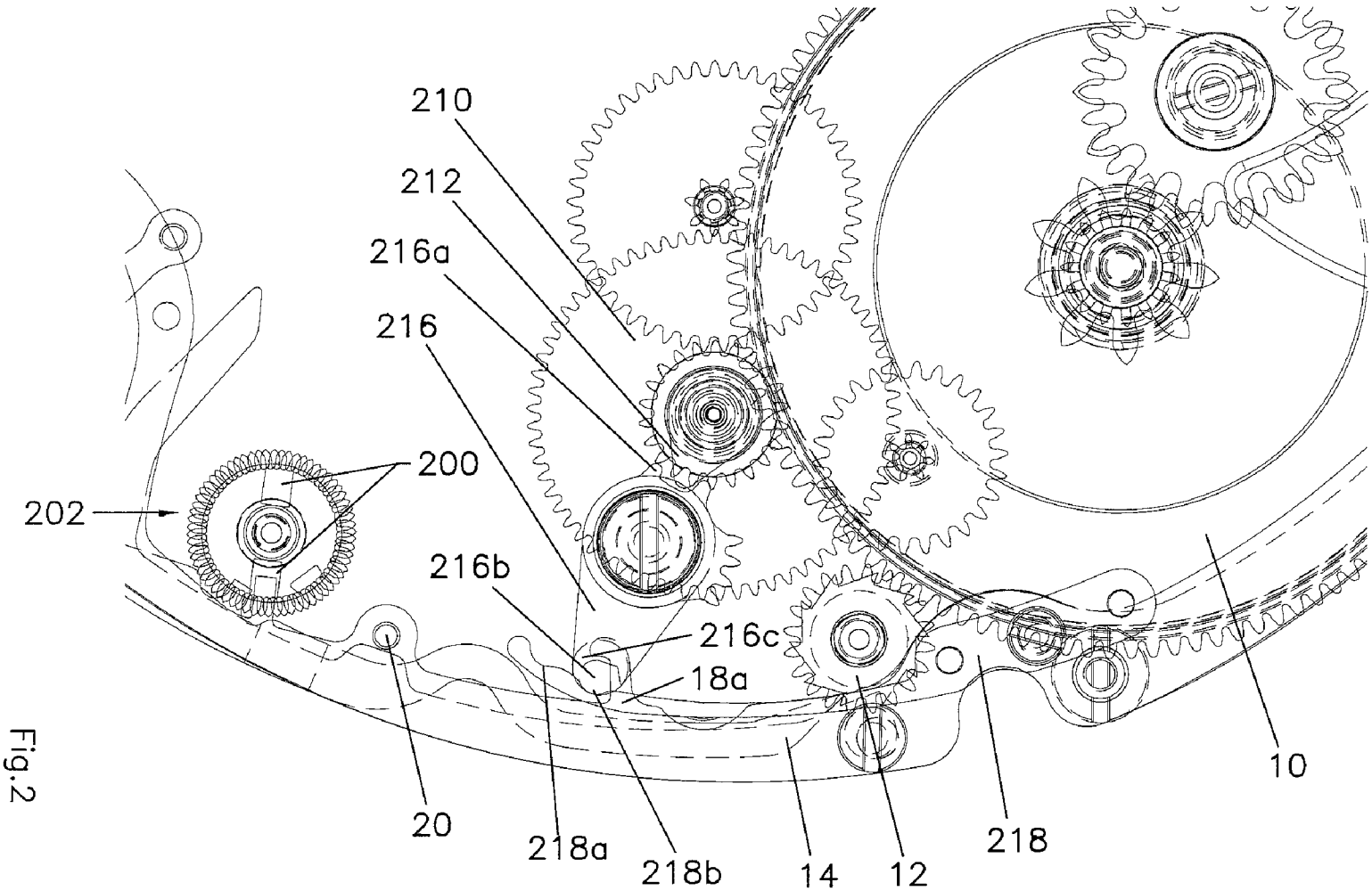
FIGS. 2 and 3 are close ups, in top views, first, of the area of the mechanism close to the barrel and, secondly, of the pallets, gongs and hammers.

In the illustrated example, the barrel 10 is automatically wound. It is kept in the wound position by a wolf tooth gear 12. More precisely, the end of a first lever 14 visible in FIG. 2 is mounted rotatably at the edge of the movement, forms a pawl which blocks the gear 12. When the wearer of the watch wants to actuate the minute repeater mechanism, he presses a button 16 protruding outside the case. This actuates a second lever 18, also located at the edge of the movement, rotating in a point X and comprising a pin 20 which cooperates with the first lever 14, next to the center of the movement.

Pressure on the button 16 causes rotation of the lever 18 whereof the pin 20 pushes the lever 14. The pawl is then lifted, which results in freeing the barrel 10.

Through a traditional gear train, the barrel 10 causes rotation of a striking driving wheel 22, rotating in clockwise in a point A, under the other parts of the repeater mechanism. The unwinding of the barrel is slowed by a brake 23 or an escapement disposed at the exit of the barrel 10.

The lever 18 comprises, moreover, a pin 18*c* being located, at rest, in one of two slots 200 developed on a diameter of a counting wheel 202, named as such because, as one will understand below, it makes it possible to determine the duration of one cycle of the repeater mechanism.

A gear train located at a lower lever relative to the elements already described, connects the barrel 10 to an intermediate mobile located under the counting wheel 202, coaxially to and linked with it. It is therefore not visible in the drawing.

When the button 16 is pressed, the lever 18 is lifted and the barrel 10 is freed. The counting wheel 202 is then driven in rotation and, when the button 16 is released, the pin 18*c* bears on the edge of the counting wheel 202 which has turned, which keeps the lever 18 in position and prevents the pawl from falling back and blocking the barrel 10. When the wheel 202 has performed one half of a revolution, the pin 18*c* goes back down into the other slot 200 and the lever 18 falls back. The pin 20 of the lever 18 no longer pushes on the lever 14, the pawl can then fall back, blocking the barrel 10. The speed of rotation of the counting wheel 202 is adjusted to allow the striking mechanism to perform one complete cycle while this wheel performs a half-revolution.

As can be better seen in FIG. 2, the barrel 10 is kinematically connected with a wheel 210 completing one revolution in a period substantially equal to that of the remaining power reserve of the barrel. This wheel makes it possible to display, in a window of the frame, information on the remaining running time of the striking barrel.

Advantageously, the wheel 210 bears, on its axis, a cam 212 intended to cooperate with a finger 216*a* of a lever 216. One of the ends of this lever 216 ends near the lever 18, particularly a hook 18*a* comprised by said lever 18. This end is provided with a pillar 216*b* located on the cam and a banking 216*c* located under it and intended to act with the hook 18*a*. A jumper-spring 218 has two adjacent housings 218*a* and 218*b* which cooperate with the pillar 216*b*. The interaction between the cam 212 and the finger 216*a* makes it possible to drive the pillar 216 from one to the other of the housings, the pressure of the spring 218 allowing the lever 216 to occupy only two positions.

The cam 212 is positioned so as to cross the finger 216*a* when the power reserve of the barrel does not make it possible to complete a full cycle of the minute repeater striking train, meaning when it is lower than approximately 30% of the total reserve.

When the remaining power reserve is greater than this value, the lever 216 is in the first of its positions, the pillar 216*b* being located in the housing 218*a* and the banking 216*c* leaving the hook 18*a* free. When the reserve becomes less than this value, the rotation of the wheel 210 and the position of the cam 212 enable this cam to push the finger 216*a* and to cause the lever 216 to move into its second position. The pillar 216*b* is then located in the housing 218*b* and the banking 216*c* is positioned in the hollow of the hook 18*a*.

Thus, when the wearer pushes the button 16 to trigger the minute repeater, the lever 18 cannot be actuated, as the banking 216*c* blocks it at the level of the hook 18*a*. The barrel therefore cannot be freed and there is no alarm.

Preferably, the display indicates in the window, when the lever is in its first position, that the repeater mechanism is usable, for example through a section of a first color and, when the lever is in its second position, that the mechanism is blocked, through a disc of another color.

Counting Element

To take information relative to the current time, the mechanism is equipped with a counting element which comprises a set of snails of a known type, driven by the going train. In summary, it comprises a minute snail 24 equipped with four arms each provided with fourteen teeth, adjusted on a rod of the cannon-pinion at the center of the movement, and a quarter snail 26 provided with three teeth, linked with the surprise. Moreover, an hour snail 28 is disposed on a star 30 with twelve teeth, advancing by one step per hour.

Advantageously and as shown in the figures, the minute snail 24 is provided with a surprise, of the traditional type, provided with a jumper-spring 31. This mechanism aims to avoid, during passage from one quarter to the next, the minute sensing arm (described below) falling directly at the "0 minute" level. One will find explanations of this well-known device in the reference cited in the introduction.

Gongs and Pallets

Figure 3:
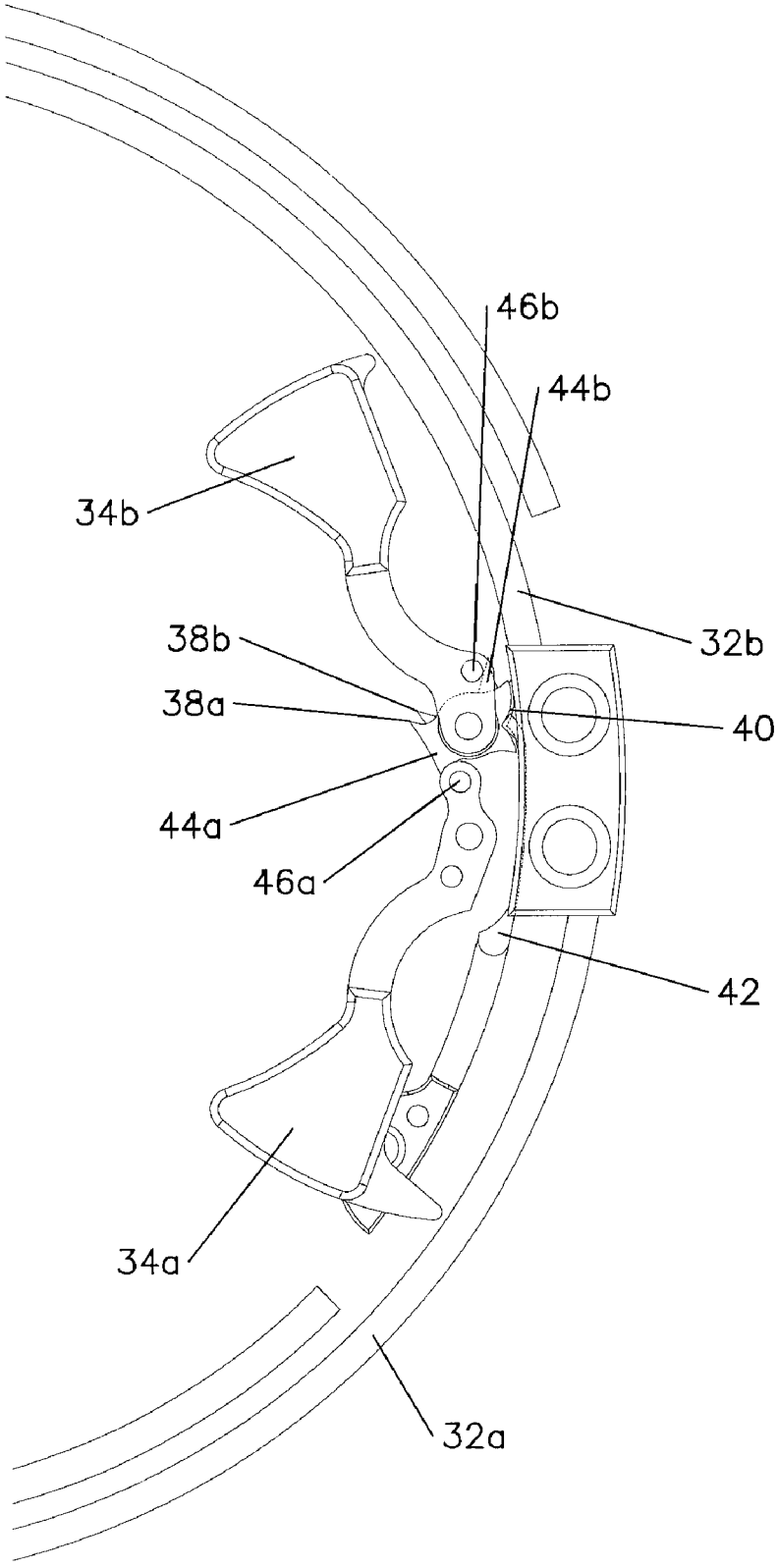

As shown particularly in FIG. 3, the repeater comprises, at its edge, two gongs 32*a* and 32*b* which two hammers 34*a* and 34*b*, moved by upper 36*a* and lower 36*b* pallets, cause to sound. The gongs 32*a* and 32*b* can be produced in just one or several independent parts. The springs and counter-springs of the hammer are not illustrated.

According to one important characteristic of the invention, these pallets are disposed coaxially. They each have:

- a beak 38 which cooperates with toothed sections in order to cause them to rotate,
- one positioning surface 40 whereon bears a spring 42 to keep them in their resting position, and
- a pallet stone 44 which acts directly on a pin 46 comprised by the hammers 34 to cause them to strike the gongs 32.

For the upper pallet 36*a*, the pallet stone 44*a* is positioned so as to act on the pin 46*a* during an ascending phase of its counterclockwise rotational movement.

For the lower pallet 36*b*, the pallet stone 44*b* is positioned so as to act on the pin 46*b* during a descending phase of its counterclockwise rotational movement.

When the toothed sections rotate counterclockwise and actuate the pallets 36 from right to left, in reference to FIG. 2, these are driven counterclockwise, which does not have any effect on the hammers 34 (as this distances the pallet stones from the pin 46), then they go back to their initial position under the effect of the spring 42.

When the toothed sections rotate clockwise and actuate the pallets 36 from left to right, in reference to FIG. 2, these are driven counterclockwise. The pallet stones 44 then push the pins 46, which makes it possible to actuate the hammers 34*a* and 34*b* and to cause the gongs 32*a* and 32*b*, respectively, to ring.

As one will understand below, the pallets can, thanks to their structure, be actuated separately or together, according to the shape and especially the thickness of the toothed sections. Moreover, in the case where one of the toothed sections encompasses the thickness of both pallets, the relative position of the beaks makes it possible to adjust the time between the strikes of the hammers.

Figure 1B:
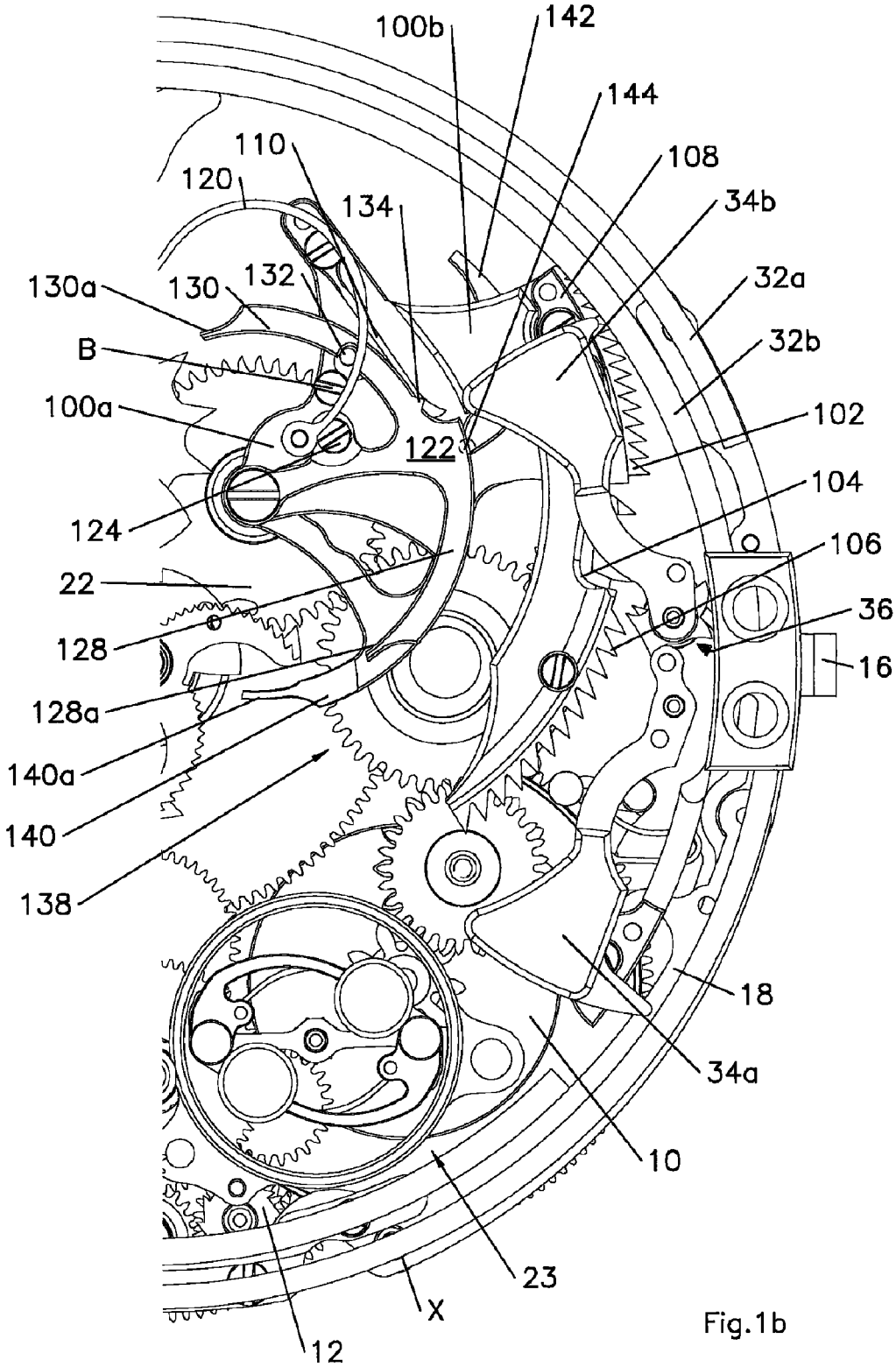

Set of Striking Parts (FIG. 1)

Particularly to the invention, a striking part 100 is mounted rotatably in A. It comprises a base 100*a* having a globally triangular shape, the point A being located near one of the angles, and a rack 100*b*. This rack 100*b* has successively, from left to right, along its outer edge, meaning from the outer side of the movement, a toothed hour section 106 positioned, in the direction of the thickness of the mechanism, at the level of the lower pallet 36*b*, a tooth-free space 104 the role of which will appear below, and a toothed minute section 102 positioned, in the direction of the thickness of the mechanism, at the level of the upper pallet 36*a*. A recess 107, visible in FIGS. 4 to 7 and the role of which will appear below, is developed at the level of the free space 104.

The striking part bears:

a first spring 108 located near the toothed sections 102 and 106, and intended to exert pressure on the free space 104, and a second spring 110 of the jumper type, the role of which will appear below, positioned at the level of one of the angles of the base 100*a* excluding that bearing the point A.

Moreover, the striking part 100 bears, under it, a lever 112 visible in FIGS. 4 to 7 and rotating in a point B. This latter part is provided with a first pin 114 intended to cooperate with the driving wheel of the striking 22, and a second pin 116 rising up on the frame side and crossing the part 100 through an opening 118. As one will see below, this pin 116 serves to actuate the lever.

Moreover, a spring 120 is fixed, on one side on the plate and, on the other side on the striking part 100, and exerts a force aiming to drive the part 100 counterclockwise. The banking means blocking the part 100 will be explained below.

A part called a trigger 122 is mounted rotatably in A on the striking part 100 and is coupled to it by a rod 124 (or a screw, for example) which goes through an oblong hole developed in the part 100. The trigger 122 comprises a first 128 and a second 130 arm in the shape of arcs of circle, oriented concentrically to the driving wheel 22. The first arm 128 ends with a sensing arm 128*a* intended to cooperate with the minute snail 24. The second arm 130 ends with a sensing arm 130*a* intended to cooperate with the hour snail 28.

Moreover, the trigger 122 has a housing 132 wherein the pin 116 of the lever 112 is positioned. Thus, thanks to the play left by the oblong opening 126, the part 100 may move relative to the trigger 122, which drives the rotation of the lever 112 and causes the pin 114 to engage on the driving wheel 22.

The second arm 130 is provided, on its outer edge, with a pin 134 intended to cooperate with the spring 110. This positions the trigger 122 such that it abuts on one or the other of the ends of the oblong opening 126. It therefore forces the lever 112 to be in one or the other of its extreme positions, meaning engaged or fully disengaged.

Figure 6:
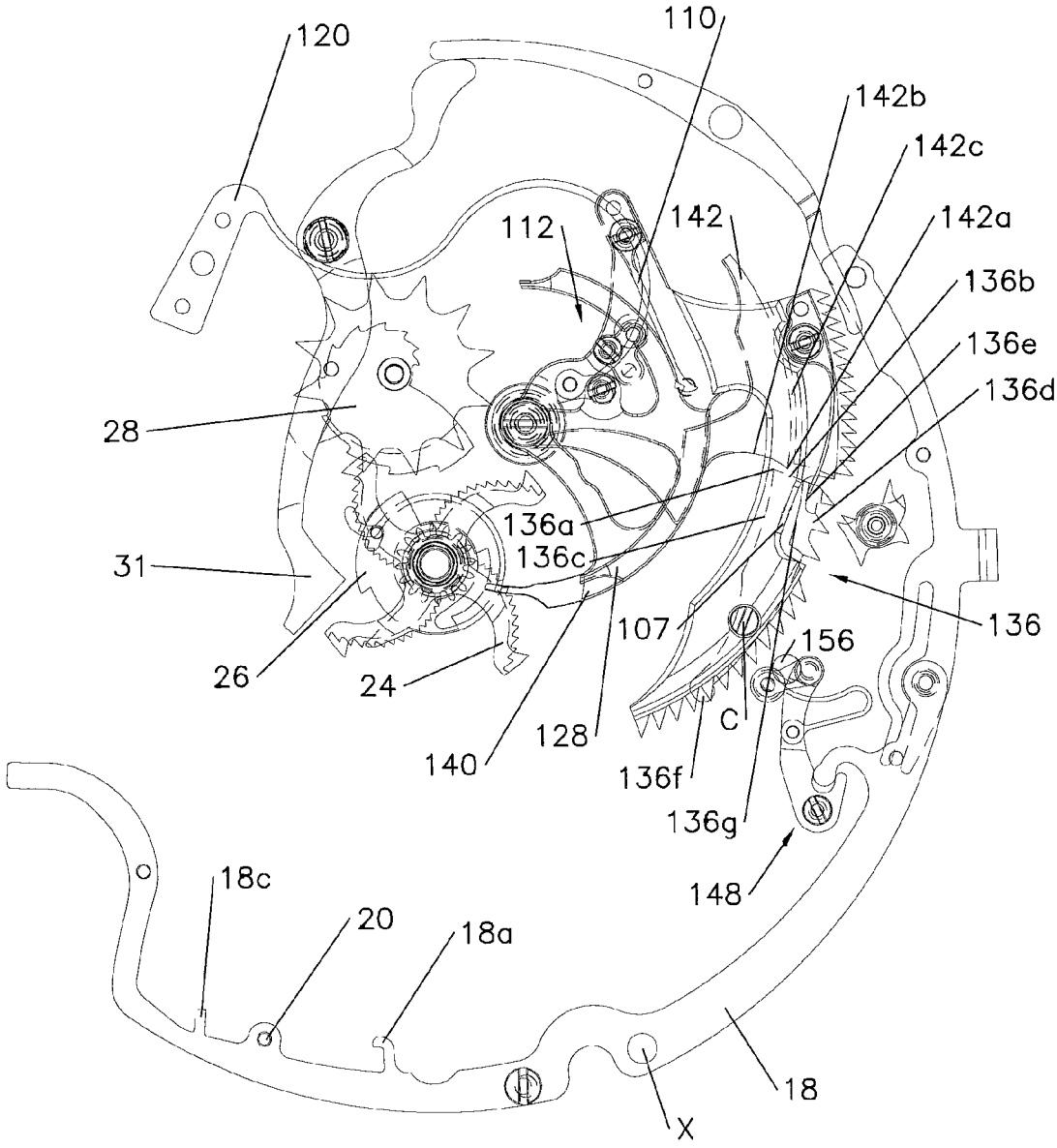

In reference to FIG. 6, a quarter part 136 is mounted rotatably, by known means, in a point C located on the striking part 100. This part 136 has, overall, the shape of a traditional striking rack. More particularly, one of its corners 136 defines, on one side, a blocking surface 136*b* and, on the other side, a support surface 136*c*. This is formed by the edge of the part 136 located next to the center of the movement which draws a circle portion centered on the point A.

The quarter part 136 presents, moreover, a toothed portion 136*d*, arranged so as to be positioned in the free space 104. This portion 136*d* comprises only three teeth, intended respectively to sound the first, second and third current quarter hour. Its thickness and its position allow the teeth to cross, in their travel, the beaks 130 of the two pallets 36. In light of the structure of these pallets described above, each tooth first actuates one 36*b* then, immediately after, the other 36*a* of the pallets, thereby producing the sound typically identifying the quarters.

Moreover, the quarter part 136 is provided with a pressure surface 136*e* with which the spring 108 cooperates, said spring 108 exerting a force aiming to cause the toothed portion 136*e* to wobble toward the center of the movement. Near this surface, the part 136 has a shoulder 136*g* intended to cooperate with the recess 107 of the striking part.

Lastly, the part 136 comprises a boss 136*f*. This boss and the toothed portion 136*d* are located on either side of the pivot point C. Thus, the boss makes it possible to actuate and rotate the part 136.

A quarter control piece 138 is assembled, under the striking part 100, rotatable around the point A. It comprises a first arm 140 ending with a sensing arm 140*a* intended to cooperate with the quarter snail 26. It also comprises a second arm 142 having a corner 142*a* defining, on one side, a blocking section 142*b*, and, on the other side, a support section 142*c*. This is formed by the edge of the arm 142 located next to the edge of the movement and draws a portion of a circle centered on the point A. The manner in which the control 138 and the quarter part 136 cooperate will be described below.

As one will better understand below, a pin 144 is positioned in the plate to limit the travel of the control 138 counterclockwise.

Trigger Elements

As one sees better in FIGS. 4 to 7, the second lever 18 mentioned above comprises a second hook 18*b* cooperating with a connecting rod 148 formed essentially by a first arm 148*a* and a second arm 148*b*. The connecting rod is mounted rotatably on the plate at a point D located at the level of the first end of the arm 148*a*. The arms 148*a* and 148*b* are hinged at a point E located at the second end of the arm 148*a* and at the first end of the arm 148*b*. A spring 150 connecting the first arm 148*a* to the second end of the second arm 148*b* exerts a force keeping the arms of the connecting rod in a semi-folded position.

The second end of the arm 148*b* has a first narrow cylindrical part 152 and a plate 154 having a larger diameter intended to act on the boss 136*f* of the quarter part 136 to cause it to rotate.

A pin 156 is fixed in the plate. It is truncated and has a flat section 156*a* intended to cooperate with the part 152 to guide the movement of the connecting rod 148.

When the button is pressed, the lever 18, through the hook 18*b*, pushes the connecting rod close to the point D so as to cause it to rotate around this point. The cylindrical part 152 bears on the flat section 156*a*, and the arms 148*a* and 148*b* unfold, putting the spring 150 under tension. At the end of the travel, the plate 154 pushes the boss 136*f*, then, the part 152 exceeds the flat section. Under the effect of the spring 150, the connecting rod 148 then goes back to its initial position, so as to avoid the plate hindering the travel of the quarter part 136.

Resting Position

Figure 4:
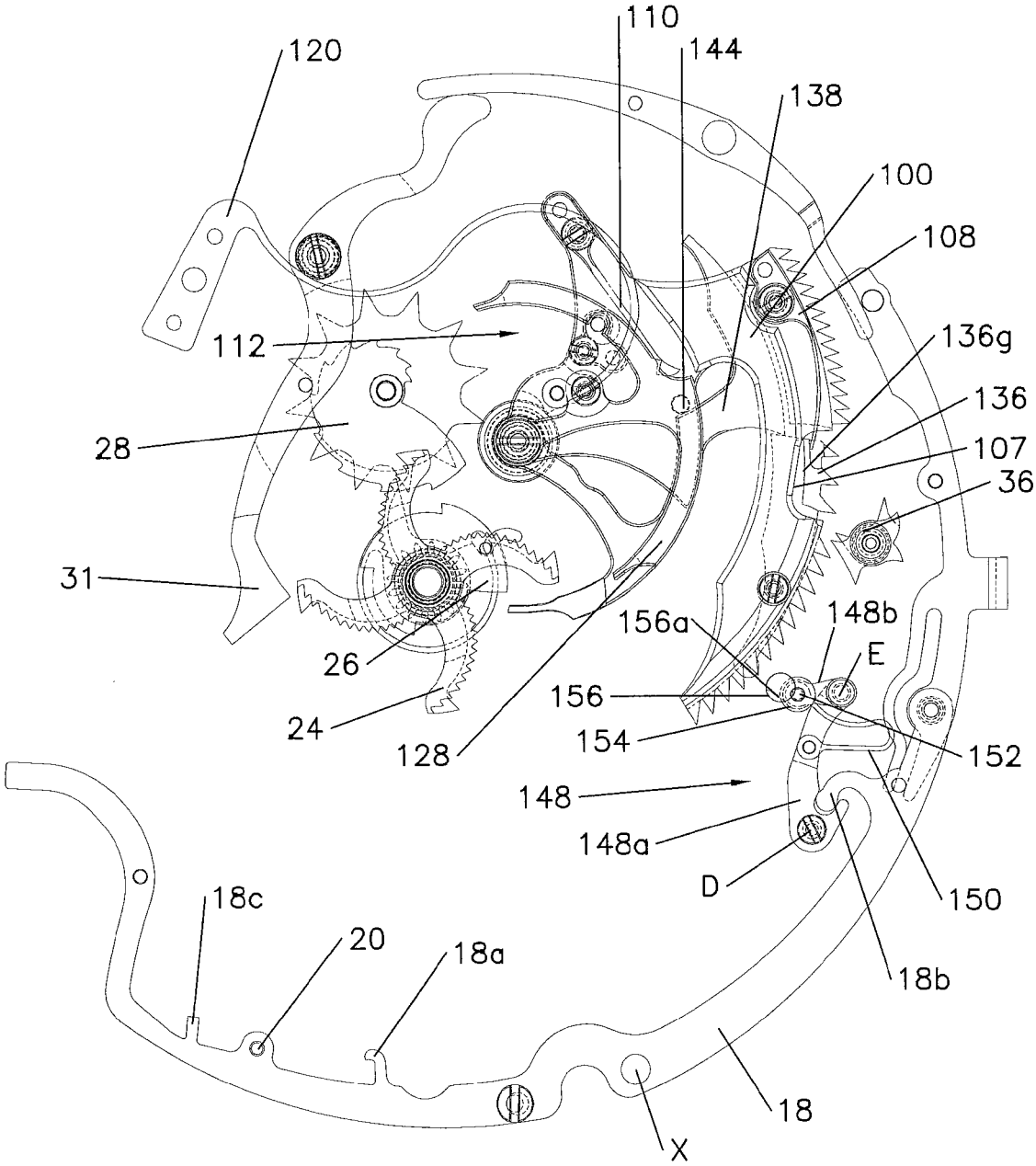
FIGS. 4 to 7 illustrate different positions of the mechanism while chiming 10:40.

For more clarity, FIG. 4 provides a close up of the area proper to the repeater mechanism in the resting position. The section 142*b* and surface 136*b* for blocking the control 138 and the quarter part 136 are face to face. Indeed, the spring 108 presses the quarter part 136, but this is positioned in abutment, thanks to the bearing of the shoulder 136*g* on the recess 107. The section 142*b* and the surface 136*b* bear on each other under the effect of the springs 120 and 108. Thanks to the spring 120, all of the striking parts are positioned by bearing of the quarter control piece 138 on the pin 144 which form a banking element.

The lever is not engaged on the driving wheel which does not turn, the striking barrel being kept blocked by the pawl lever 14.

Figure 7:
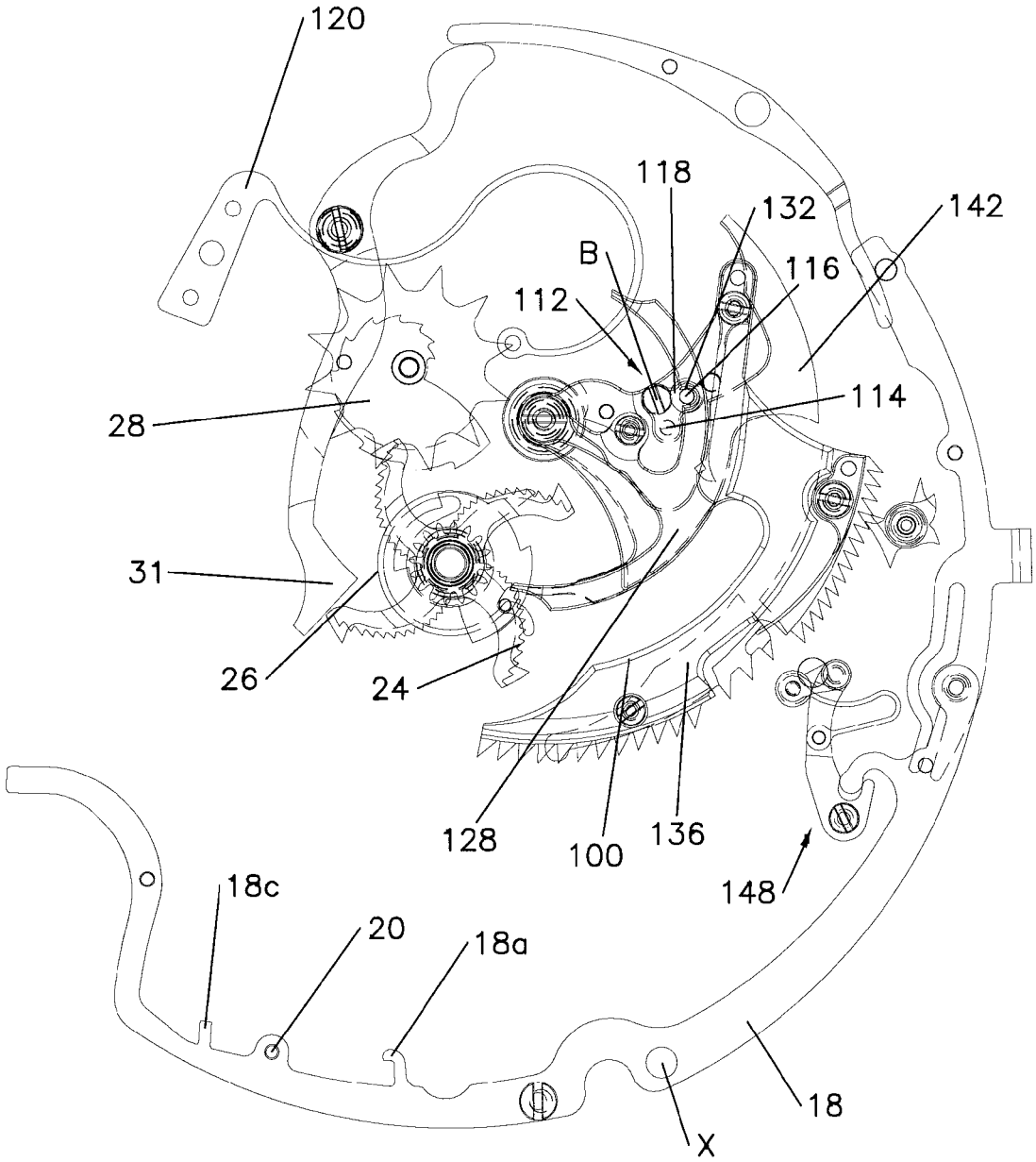

The paragraphs below refer to FIGS. 5 to 7 and explain the operation of the mechanism during the striking corresponding to the indication of 10:40.

Triggering

To operate the striking train, the wearer presses the button 16. On one hand, this drives, through the levers 14 and 18, the liberation of the striking barrel 10 which causes the driving wheel 22 to rotate. On the other hand, the connecting rod 148 bears on the boss 136*f* and causes the part 136 to rotate. The blocking section 142*b* and surface 136*b*, of the control 138 and the quarter part 136, respectively, slide on one another.

When, the rotation of the part 136 continuing, the corners 136*a* and 142*a* escape from one another, the assembly of striking parts formed by the part 100, the trigger 122 and the quarter part 136, turns counterclockwise around the point A, until the hour sensing arm 130*a* bears on the hour snail 28. The toothed sections 102 and 136*d* actuate the pallets 36 without having any effect on the hammers. The striking part 100 positions itself such that ten teeth are upstream of the pallets, meaning that they are ready to actuate them again when the strike parts will turn clockwise, with, this time, an effect on the hammers 34.

The movement relative to the striking parts, particularly the quarter part 136, relative to the quarter control piece 138, brings the support surface 136*c* into contact with the support section 142*c*. The spring 108 presses on the pressure surface 136*e* of the quarter part 136 which bears on the arm 142 of the quarter control piece 138. The toothed portion 136*d* remains at the level of the toothed minute sections 102 and hour sections 106 and is able to cross the beaks 38 of the pallets 36.

The counterclockwise movement of the set of striking parts results in engaging the lever 112 on the driving wheel 22. Thanks to the combined action of the jumper 110, engagement only takes place after the sensing arm 130*a* has taken its information from the hour snail 28.

Once engaged, the driving wheel 22 brings all of the striking parts back clockwise. Under the effect of the pressure of the spring 108, the friction created between the support surface 136*c* and the support section 142*c* makes it possible also to drive the quarter control piece clockwise.

The ten teeth of the hour section 106 positioned upstream from the pallet 36*a* successively cross the beak 38*a* and actuate the hammer 34*a* which strikes the gong 20*a* to strike the ten hour blows.

Then, still moved by the wheel 22, the teeth of the portion 136*d* in turn cross the beaks of the pallets. Thanks to their thickness, they successively push the two pallets 36 and actuate the two hammers 34*b* and 34*a* which strike, in an out of sync manner, the gongs 32*b* and 32*a* to sound the quarters.

When, still driven by the friction of the striking part, the sensing arm 142*b* of the quarter control piece 138 bears on the quarter snail 26 to take information relative to the number of quarters of the current time, the part 138 stops its movement. The corner 142*a* of the quarter control piece 138 is then positioned such that, when the corner 136*a* of the quarter part 136 arrives at the level of that 142*a* of the control, the number of teeth useful to the striking has crossed the pallets 36.

In the example illustrated in FIG. 6 (40 minutes), when two quarters have struck, all of the striking parts continuing their movement, the corners 136*a* and 142*a* escape again. The quarter part 136 is then no longer bearing on the second arm 142 and wobbles under the effect of the spring 108 until the shoulder 136*g* bears on the recess 107. In this way, the quarter teeth not useful to the striking (the third tooth in the example) move aside and do not cross the pallets 36 during the continuation of the movement of the striking parts.

The part 100 and the quarter part 136 continue their rotation, still under the action of the driving wheel 22. The teeth of the minute section 102 then cross the beak 38*b* of the pallet 36*b* and push it successively to actuate the hammer 34*b* which strikes the gong 20*b* to strike the minutes.

Figure 5:
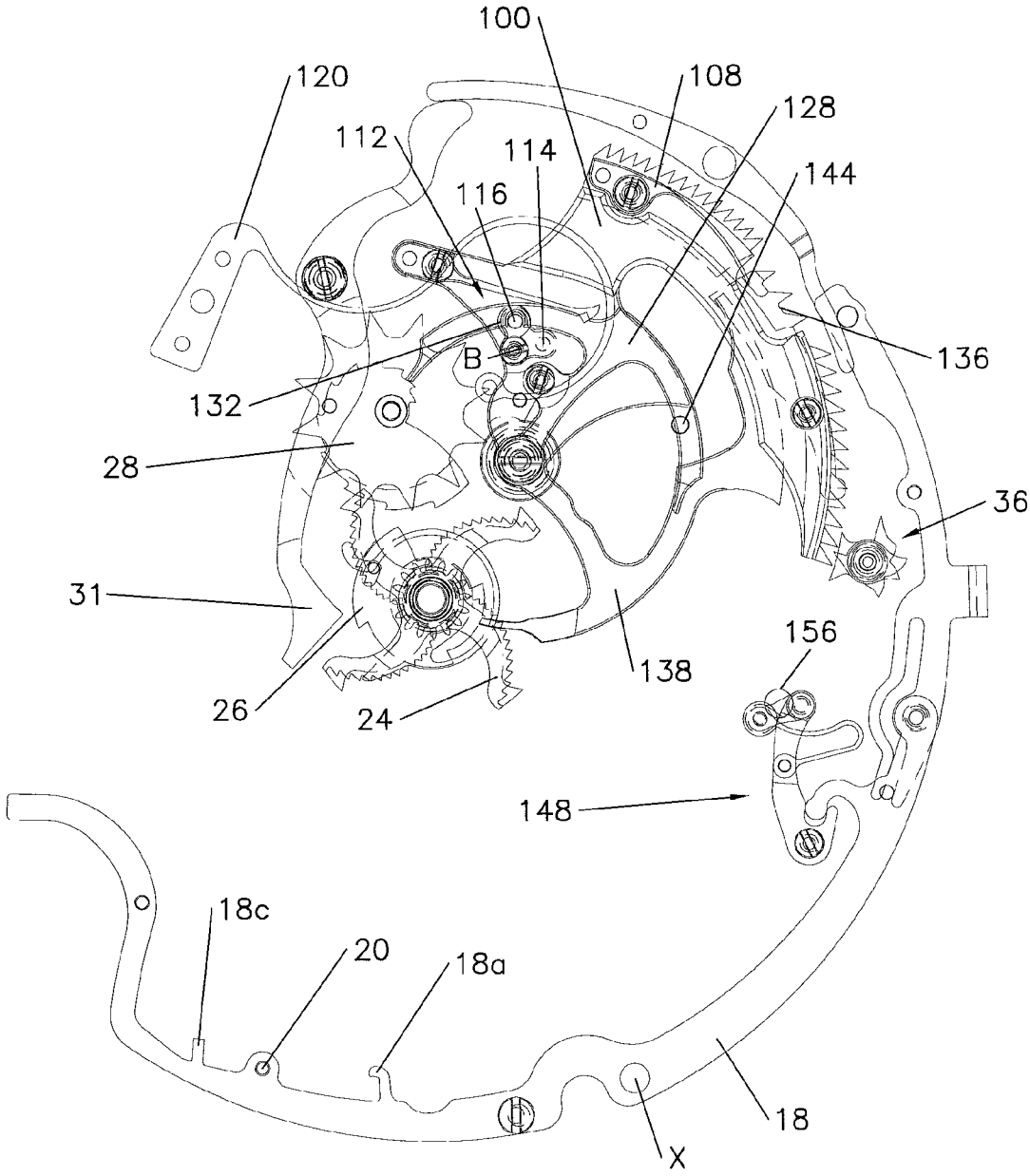

The striking of minutes continues until the minute sensing arm 128*a* arrives to take its information on the minute snail 24, which stops the movement of the trigger 122 (FIG. 5). The number of teeth having then crossed the pallet 36*b* corresponds to the number of minutes to sound (10 in the example). The striking part 100 is still moved by the driving wheel 22. Thanks to the oblong opening, the parts 100 and 122 then have a relative movement which actuates the lever 112 and causes the disengagement of the wheel 22.

All of the striking parts then no longer being driven, the spring 120 brings the striking and quarter parts back to the resting position described above. The counting wheel 202 makes it possible for the barrel 10 to remain freed for the duration of the cycle of the repeater mechanism.

Thus a minute repeater mechanism is proposed which comprises a reduced number of parts. It is, because of this, easier to produce and adjust, particularly at the level of the quarter striking train.

In one variation, the three teeth of the quarter section can actuate non-coaxial pallets, but whereof the centers of rotation are very close. It is sufficient for the distance between the two beaks to be smaller than the distance separating two consecutive teeth.

The invention claimed is:

1. A striking part adapted to be rotatingly mounted on a minute repeater mechanism, wherein it comprises a single rack which has successively, along one of its edges, a toothed hour section, a tooth-free space and a toothed minute section, said toothed hour section being intended to actuate first means for emitting a sound and said toothed minute section being intended to actuate second means for emitting a second different sound.

2. The striking part of claim 1, wherein it supports a trigger, comprising a first and second arm each provided with a sensing arm to take an information relating to the current time.

3. The striking part according to claim 1, wherein a quarter part comprising a toothed quarter section is mounted rotatably relative to said striking part such that the toothed quarter section is able to appear exclusively in said tooth-free space.

4. The striking part of claim 1, wherein said toothed hour section comprises twelve teeth and said tooth minute section comprises fourteen teeth.

5. The striking part of claim 1, wherein the toothed minute and hour sections are located in different planes relative to the thickness of said minute repeater mechanism.

6. The striking part of claim 5, wherein it supports a trigger, comprising a first and second arm each provided with a sensing arm to take an information relating to the current time.

7. The striking part according to claim 5, wherein a quarter part comprising a toothed quarter section is mounted rotatably relative to said striking part such that the toothed quarter section is able to appear exclusively in said tooth-free space.

8. A timepiece comprising a minute repeater mechanism equipped with:

a power source powering this mechanism, a control member to actuate this mechanism, a counting element to take information on the current time, comprising:

an hour snail, an hour sensing arm, a quarter snail, a quarter sensing arm, a minute snail, a minute sensing arm, a toothed hour section, one for quarters and one for minutes mounted rotatably and the movement of which is determined by said counting organ, and means for emitting a sound, comprising:

two pallets able to be actuated by one and/or the other of the toothed sections, two hammers moved by pallets, and two gongs whereon strike said hammers to emit a sound, wherein said toothed hour and minute sections are located on a striking part comprising a rack which has successively, along one of its edges, a toothed hour section, a tooth-free space and a toothed minute section.

9. The timepiece of claim 8, wherein said pallets are disposed coaxially and each comprising:

a beak which cooperates with toothed sections mounted mobile in said movement in order to cause said pallets to rotate, a positioning surface whereon bears an elastic element to keep the pallets in their resting position, and a pallet stone which acts directly on a pin comprised by the hammers, and wherein said toothed quarter section encompasses, in its thickness, the beaks of the two pallets.

10. The timepiece of claim 8, wherein the toothed hour and minute sections are positioned, in the direction of the thickness of the mechanism, respectively in the plane of one and the other of the pallets.

11. The timepiece of claim 10, wherein said pallets are disposed coaxially and each comprising:

a beak which cooperates with toothed sections mounted mobile in said movement in order to cause said pallets to rotate, a positioning surface whereon bears an elastic element to keep the pallets in their resting position, and a pallet stone which acts directly on a pin comprised by the hammers, and wherein said toothed quarter section encompasses, in its thickness, the beaks of the two pallets.

12. The timepiece of claim 10, wherein the power source is a barrel the power of which is transmitted to said mechanism through a driving wheel, wherein said trigger and said striking part rotate at the center of said wheel, at least one of said first and second arms of the trigger being oriented concentrically to the driving wheel, and wherein the trigger is coupled with play to the striking part, said play being able to create a relative movement of said trigger relative to said striking part which, through a lever linked with said striking part and moved by said trigger, engages or disengages the striking part with said driving wheel.

13. The timepiece of claim 12, wherein said pallets are disposed coaxially and each comprising:

a beak which cooperates with toothed sections mounted mobile in said movement in order to cause said pallets to rotate, a positioning surface whereon bears an elastic element to keep the pallets in their resting position, and a pallet stone which acts directly on a pin comprised by the hammers, and wherein said toothed quarter section encompasses, in its thickness, the beaks of the two pallets.

14. The timepiece of claim 8, wherein the power source is a barrel the power of which is transmitted to said mechanism through a driving wheel, wherein said trigger and said striking part rotate at the center of said wheel, at least one of said first and second arms of the trigger being oriented concentrically to the driving wheel, and wherein the trigger is coupled with play to the striking part, said play being able to create a relative movement of said trigger relative to said striking part which, through a lever linked with said striking part and moved by said trigger, engages or disengages the striking part with said driving wheel.

15. The timepiece of claim 14, wherein said pallets are disposed coaxially and each comprising:

a beak which cooperates with toothed sections mounted mobile in said movement in order to cause said pallets to rotate, a positioning surface whereon bears an elastic element to keep the pallets in their resting position, and a pallet stone which acts directly on a pin comprised by the hammers, and wherein said toothed quarter section encompasses, in its thickness, the beaks of the two pallets.

16. The timepiece of claim 8, wherein said striking part comprises a recess, and wherein the quarter part is provided with a shoulder and a pressure surface with which cooperates a first positioning spring, exerting a force aiming to bring said shoulder to abut on said recess.

17. The timepiece of claim 16, wherein said pallets are disposed coaxially and each comprising:

a beak which cooperates with toothed sections mounted mobile in said movement in order to cause said pallets to rotate, a positioning surface whereon bears an elastic element to keep the pallets in their resting position, and a pallet stone which acts directly on a pin comprised by the hammers, and wherein said toothed quarter section encompasses, in its thickness, the beaks of the two pallets.

18. The timepiece according to claim 16, wherein a second spring exerts a force on the striking part aiming to drive it in rotation and wherein said positioning spring and said second spring bring said quarter part against a banking element which keeps said mechanism in its resting position.

19. The timepiece of claim 18, wherein said pallets are disposed coaxially and each comprising:

a beak which cooperates with toothed sections mounted mobile in said movement in order to cause said pallets to rotate, a positioning surface whereon bears an elastic element to keep the pallets in their resting position, and a pallet stone which acts directly on a pin comprised by the hammers, and wherein said toothed quarter section encompasses, in its thickness, the beaks of the two pallets.

20. A Striking mechanism for timepiece movement comprising:

at least one resonant element which can emit at least two sounds of different frequencies, at least two pallets disposed coaxially and each comprising:

a beak which cooperates with toothed sections mounted mobile in said movement in order to cause said pallets to rotate, a positioning surface whereon bears an elastic element to keep the pallets in their resting position, and a pallet stone which acts directly on a pin comprised by a hammer at least two hammers each comprising a pin whereon directly acts said pallet stones to make them strike said resonant element, wherein the pallet stone of a first pallet is positioned so as to act on the pin of a first hammer during an ascending phase of its rotational movement in a first direction, and wherein the pallet stone of a second pallet is positioned so as to act on the pin of a second hammer during a descendant phase of its rotational movement in said first direction.

* * * * *